US007528549B2

(12) United States Patent
Almanstötter et al.

(10) Patent No.: US 7,528,549 B2
(45) Date of Patent: May 5, 2009

(54) PROCESS FOR PRODUCING AN ELECTRODE FOR HIGH-PRESSURE DISCHARGE LAMPS, AND AN ELECTRODE AND A HIGH-PRESSURE DISCHARGE LAMP WITH SUCH ELECTRODES

(75) Inventors: Jürgen Almanstötter, Hiltenfingen (DE); Dirk Grundmann, Berlin (DE); Klaus Günther, Neu Lutterow (DE); Thomas Hartmann, Berlin (DE)

(73) Assignee: Osram Gesellschaft Mit Beschaenkter Haftung, Munich (DE)

( * ) Notice: Subject to any disclaimer, the term of this patent is extended or adjusted under 35 U.S.C. 154(b) by 539 days.

(21) Appl. No.: 11/209,636

(22) Filed: Aug. 24, 2005

(65) Prior Publication Data

US 2006/0049761 A1 Mar. 9, 2006

(30) Foreign Application Priority Data

Sep. 7, 2004 (DE) ..... 10 2004 043 247

(51) Int. Cl.

| | |
|---|---|
| ***H01J 61/073*** | (2006.01) |
| ***H01J 17/04*** | (2006.01) |
| *H01J 61/04* | (2006.01) |
| *H01J 17/20* | (2006.01) |

(52) U.S. Cl. ..... 313/633; 313/637; 313/642; 313/640

(58) Field of Classification Search ..... 313/631–637
See application file for complete search history.

(56) References Cited

U.S. PATENT DOCUMENTS

| | | | | |
|---|---|---|---|---|
| 5,866,975 | A * | 2/1999 | Gartner et al. | 313/346 DC |
| 6,891,332 | B1 * | 5/2005 | Irisawa et al. | 313/631 |
| 2003/0155864 | A1 * | 8/2003 | Wada et al. | 313/631 |
| 2004/0007979 | A1 * | 1/2004 | Aoki et al. | 313/633 |

FOREIGN PATENT DOCUMENTS

| | | |
|---|---|---|
| DE | 101 37 794 | 3/2003 |

* cited by examiner

*Primary Examiner*—Sikha Roy
*Assistant Examiner*—Tracie Y Green

(57) ABSTRACT

A process for producing an electrode for high-pressure discharge lamps, at least the discharge-side section of the electrode being produced from a prefabricated tungsten wire, which is shortened to the required length during the production process of the electrode and subjected to an annealing process as well as being mounted on other components of the electrode that may be present. The annealing process is carried out exclusively at temperatures below 1500 degrees Celsius. The invention also relates to an electrode for high-pressure discharge lamps, at least the discharge-side section of the electrode being constructed as a tungsten rod that has a long crystalline structure or an isotropic crystalline structure with grain diameters in the radial direction of the tungsten rod of less than or equal to 50 micrometers with the centroid of the grain size distribution in the range from 10 micrometers to 20 micrometers.

9 Claims, 3 Drawing Sheets

Figure 1:
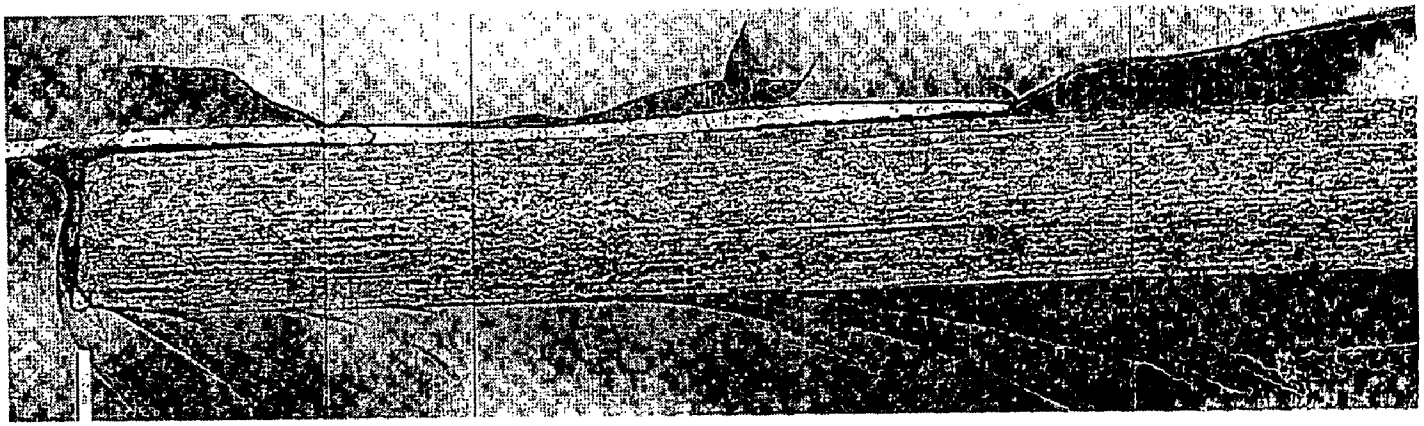

PROCESS FOR PRODUCING AN ELECTRODE FOR HIGH-PRESSURE DISCHARGE LAMPS, AND AN ELECTRODE AND A HIGH-PRESSURE DISCHARGE LAMP WITH SUCH ELECTRODES

I. TECHNICAL FIELD

The invention relates to a process for producing an electrode for high-pressure discharge lamps, at least the discharge-side section of the electrode being produced from a prefabricated tungsten wire, the tungsten wire being shortened to the required length during the production process of the electrode and being subjected to an annealing process as well as being mounted on other components of the electrode that may be present, and to a corresponding electrode and a high-pressure discharge lamp with such electrodes.

II. BACKGROUND ART

Laid-open patent specification DE 101 37 794 A1 discloses a tungsten electrode for high-pressure discharge lamps whose discharge-side end has an end face that is provided with at least one needle-like elevation whose thickness is substantially smaller than the thickness of the electrode. This at least one needle-like elevation ensures a defined attachment for the discharge arc of the high-pressure discharge lamp. It is thereby possible to lower the power loss and the temperature of the electrode as well as the electron work function of the electrode material. In particular, there is no need to add thorium oxide to the electrode material in order to improve the ignition quality of the lamp.

III. DISCLOSURE OF THE INVENTION

It is the object of the invention to provide an improved production process for such an electrode, as well as such an electrode.

This object is achieved according to the invention by a process for producing an electrode for high-pressure discharge lamps, at least the discharge-side section of the electrode being produced from a prefabricated tungsten wire, the tungsten wire being shortened to the required length during the production process of the electrode and being subjected to an annealing process as well as being mounted on other components of the electrode that may be present, wherein the annealing process is carried out exclusively at temperatures below 1500 degrees Celsius. Particularly advantageous designs of the invention are described in the dependent patent claims.

The process according to the invention for producing an electrode for high-pressure discharge lamps from a prefabricated tungsten wire that is shortened to the required length during the production process of the electrode and is subjected to an annealing process as well as being mounted on other components of the electrode that may be present is distinguished in that the annealing process is carried out exclusively at temperatures below 1500 degrees Celsius.

This measure ensures that it is impossible during the annealing process for there to form in the tungsten wire the monocrystalline regions of large volume that are normally desired in the case of the electrodes in accordance with the prior art, but that instead of this the grain structure produced by the drawing processes during the fabrication of the tungsten wire and having fiber-like crystals oriented in the longitudinal direction of the tungsten wire is substantially retained, and the so called growth of course grains in the tungsten wire is avoided. The tungsten wire or tungsten rod, illustrated in FIG. 1, thus treated has a fine, long crystalline structure with grain diameters in the radial direction of the tungsten rod of less than or equal to 50 micrometers with a centroid of the grain size distribution in the range from approximately 10 micrometers to 20 micrometers. That is to say the width of the grains is less than or equal to 50 micrometers, the definition of the width being the measurement of the grain width transverse to the longitudinal extent of the electrode at a distance of half the electrode diameter from the discharge-side electrode tip, and the maximum of the grain size distribution being in the range from 10 micrometers to 20 micrometers.

During the firing phase of the high-pressure discharge lamps fitted with electrodes fabricated using the process according to the invention, the fiber-like crystals split at the discharge-side end of the electrodes, thus leading to the construction of an electrode head that has at least a roughened surface or a surface strewn with furrows. The furrowed surface of the electrode head offers excellent attachment points for the discharge arc of the high-pressure discharge lamp. Furthermore, the electrode head covered with furrows reduces the electron work function in such a way that no further emitter materials are required in order to release electrons for the gas discharge in the high-pressure discharge lamp. In particular, there is no need for addition of thorium oxide to the electrode material in order to ensure a low temperature of the electrode at the attachment surface of the discharge arc, and a low electrode power loss of the high-pressure discharge lamp. It is possible instead of this to use a tungsten material doped in the ppm range with potassium, silicon and aluminum in order to produce the electrode according to the invention.

Figure 2:
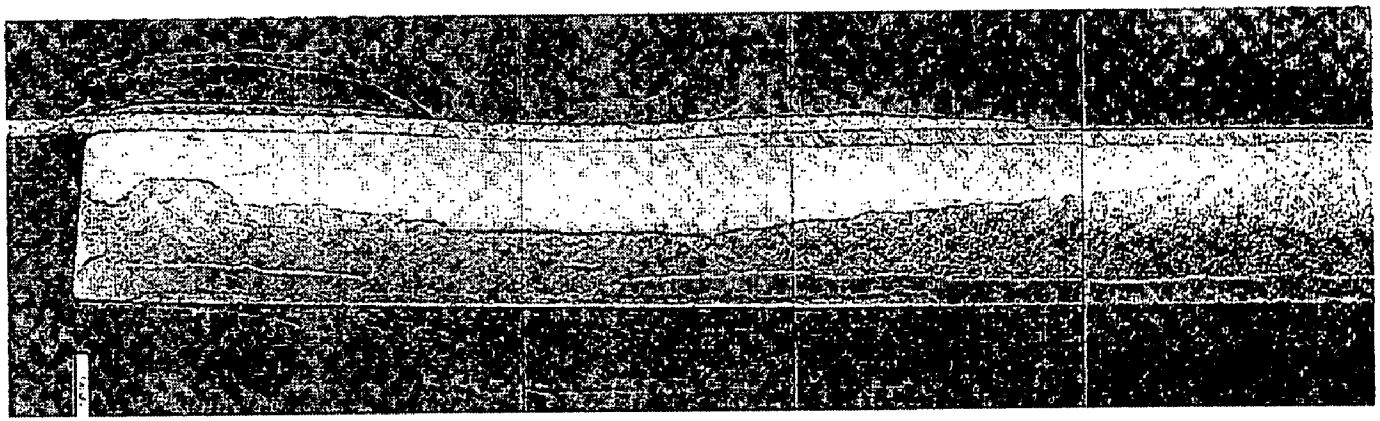

By contrast, in the case of the tungsten electrodes according to the prior art that are shown in FIG. 2 and are usually subjected to annealing processes far above 1500 degrees Celsius, there is formed during the firing phase of the high-pressure discharge lamp a spherical electrode head with a comparatively smooth surface that does not offer a defined point of attachment for the discharge arc in the lamp. The tungsten rod illustrated in FIG. 2 has a course-grained crystal structure, that is to say it has large monocrystalline areas. The tungsten electrode according to the prior art that is illustrated in FIG. 2 has the same dimensions as the electrode in accordance with the preferred exemplary embodiment of the invention.

The annealing process of the process according to the invention is advantageously carried out in a hydrogen atmosphere in order to liberate cleaning of the tungsten rod from contaminants caused by the drawing processes. Moreover, the annealing process is carried out exclusively at temperatures below 1500 degrees Celsius and, specifically, preferably in the temperature range from 1100 degrees Celsius to 1300 degrees Celsius. It has emerged that a recrystallization of the tungsten with attendant growth in course grains can be prevented by annealing in this temperature range. The use of a tungsten rod or tungsten wire with a tungsten fraction of at least 99 percent by weight and a slight potassium fraction, preferably of less than 100 ppm (100 parts per million) has proved to be particularly advantageous for the production process according to the invention and for the electrode according to the invention. In addition, for reasons of production engineering the material of the tungsten rod also has slight amounts, that is to say amounts presiding in the ppm range, of silicon and aluminum. The additives of potassium, aluminum and silicon facilitate the drawing processes in the fabrication of the tungsten rod and contribute to the stabilization of the fiber-like grain structure explained above.

In the case of the electrode according to the invention, at least the discharge-side end is formed by a tungsten rod, the tungsten rod having a long crystalline structure or an isotropic crystalline structure with grain diameters in the radial direction of the tungsten rod of less than or equal to 50 micrometers with the centroid of the grain size distribution in the range from 10 micrometers to 20 micrometers.

Figure 4:
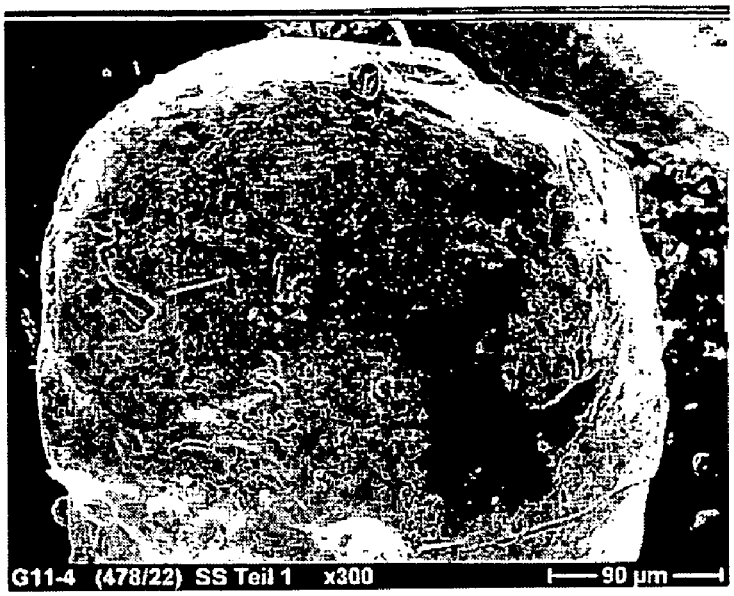
Figure 5:
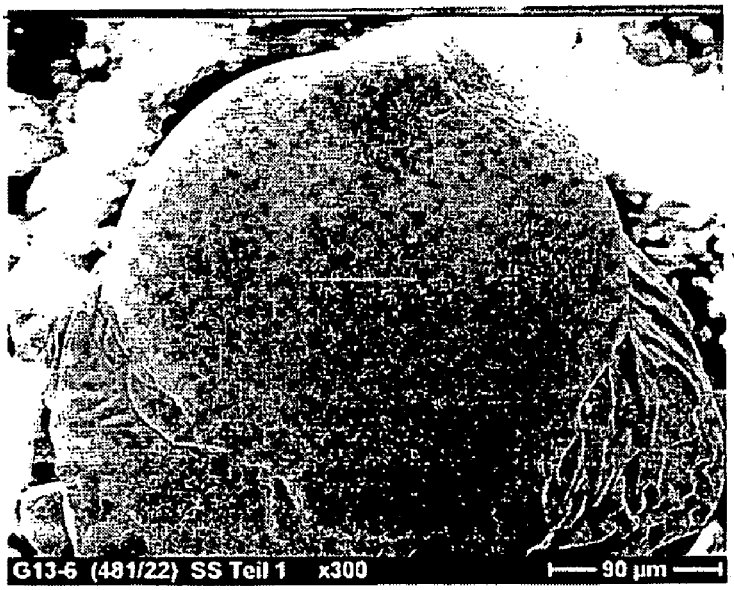

As already mentioned above, the tungsten rod of the electrode according to the invention preferably consists up to at least 99 percent by weight of tungsten and has slight amounts, that is to say in the ppm range, of potassium, silicon and aluminum. The fraction of potassium is smaller than 100 ppm. As already described above, when this electrode is used in a high-pressure discharge lamp an electrode head is formed with a rough or furrowed surface, or even a split electrode head that offers a stable point of attachment for the discharge arc and lowers the electron work function such that no emitter materials are required. The electrode according to the invention is therefore free from thorium or thorium oxide. FIGS. 4 and 5 show a comparison of an electrode head of an electrode according to the invention (FIG. 4) with that of an electrode in accordance with the prior art (FIG. 5) after the firing phase of the high-pressure discharge lamp. The electrode head in accordance with the prior art that is illustrated in FIG. 5 has a smooth surface by comparison with the electrode head according to the invention illustrated in FIG. 4.

The electrode according to the invention can be used with particular advantage in mercury-free metal-halide high-pressure discharge lamps for motor vehicle headlights. With these lamps, as well, it is possible to dispense with the addition of thorium oxide to the electrode material when use is made of the electrodes according to the invention.

IV. BRIEF DESCRIPTION OF THE DRAWINGS

Figure 3:
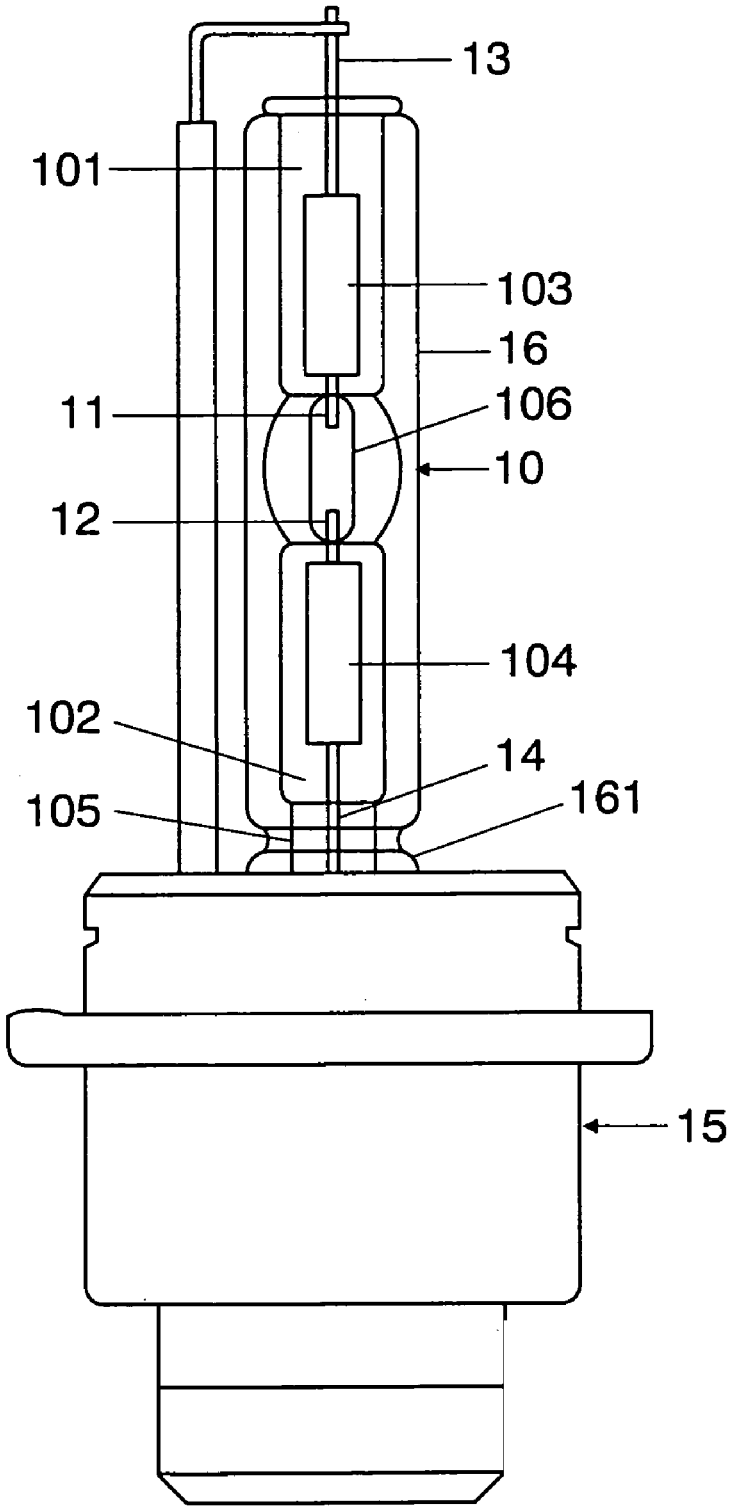

The invention is explained in more detail below with the aid of a preferred exemplary embodiment. In the drawing:

FIG. 1 shows an image, magnified one hundred times, of a section of the electrode according to the invention, FIG. 2 shows an image, magnified one hundred times, of a section of an electrode in accordance with the prior art, FIG. 3 shows a schematic of a mercury-free metal-halide high-pressure discharge lamp, FIG. 4 shows an image, magnified by the factor 300, of the electrode head of the electrode from FIG. 1 after its mounting in the mercury-free metal-halide high-pressure discharge lamp and after termination of the firing phase of the lamp, and FIG. 5 shows an image, magnified by the factor 300, of the electrode head of the electrode from FIG. 2 after its mounting in a mercury-free metal-halide high-pressure discharge lamp and after termination of the firing phase of the lamp.

V. BEST MODE FOR CARRYING OUT THE INVENTION

The electrode 11 illustrated in FIG. 1 is a unipartite pin electrode that consists of a tungsten rod with a diameter of 0.3 mm and a length of 7.5 mm. The tungsten rod 11 has a tungsten fraction of approximately 99.9 percent by weight, and has a low fraction of potassium in the range from 60 ppm to 95 ppm as well as even lower fractions of silicon (smaller than 5 ppm) and aluminum (smaller than 10 ppm). The tungsten rod 11 has a long crystalline structure with grain diameters in the radial direction of the tungsten rod of between 5 micrometers and 50 micrometers with a centroid of the grain size distribution in the range from 10 micrometers to 20 micrometers.

The starting material for the production of the electrode according to the invention or of the tungsten rod 11 is tungsten wire that is produced by means of the known and customary powder metallurgy method with the aid of sintering, forging, rolling and drawing processes. The prefabricated tungsten wire already has the same diameter as the tungsten rod 11. The tungsten wire is shortened to the above-named length in order to obtain the tungsten rod 11, and subsequently subjected to cleaning annealing in a hydrogen atmosphere at a temperature in the range from 1100 degrees Celsius to 1300 degrees Celsius for a duration in the range from 30 to 60 minutes.

Two of the electrodes or of the tungsten rods 11, 12 are mounted in the discharge vessel of a high-pressure discharge lamp, preferably a metal-halide high-pressure discharge lamp for motor vehicle headlights. Such a lamp is illustrated schematically in FIG. 3.

The preferred exemplary embodiment of the invention is a mercury-free metal halide high-pressure discharge lamp with an electric power consumption of approximately 35 watts. This lamp is provided for use in a vehicle headlight. It has a discharge vessel 30 that is sealed at both ends, is made from quartz glass and has a volume of 24 $mm^3$ in which an ionizable filling is enclosed in a gas-tight fashion. In the area of the discharge space 106, the inner contour of the discharge vessel 30 is of circularly cylindrical design, and its outer contour of ellipsoid design. The inside diameter of the discharge space 106 is 2.6 mm and its outside diameter is 6.3 mm. The two ends 101, 102 of the discharge vessel 10 are sealed in each case by means of a molybdenum foil seal 103, 104. Located in the interior of the discharge vessel 10 are two electrodes 11, 12 between which the discharge arc responsible for the emission of light is formed during operation of the lamp. The electrodes 11, 12 consist of tungsten. Their thickness or their diameter is 0.30 mm. The distance between the electrodes 11, 12 is 4.2 mm. The electrodes 11, 12 are in each case connected in an electrically conductive fashion to an electric terminal of the lamp base 15, consisting substantially of plastic, via one of the molybdenum foil seals 103, 104 and via the power supply lead 13 remote from the base or via the base-side power supply lead 14. The discharge vessel 10 is sheathed by a glass outer bulb 16. The outer bulb 16 has a projection 161 anchored in the base 15. On the base side, the discharge vessel 10 has a tubular extension 105 made from silica glass in which the base-side power supply lead 14 runs.

The ionizable filling enclosed in the discharge vessel consists of xenon with a cold filling pressure of 11 800 hPa, 0.25 mg sodium iodide, 0.18 mg scandium iodide, 0.03 mg zinc iodide and 0.0024 mg indium iodide. The operation voltage level U of the lamp is 45 volts. Its color temperature is 4000 kelvin, and in the standard chromaticity diagram according to DIN 5033 its color locus is at the color coordinates x=0.383 and y=0.389. Its color rendering index is 65 and its light yield is 90 lm/W.

What is claimed is:

1. An electrode for high-pressure discharge lamps, at least the discharge-side section of the electrode being constructed as a tungsten rod, wherein the tungsten rod has a long crystalline structure or an isotropic crystalline structure with grain diameters in the radial direction of the tungsten rod of less than or equal to 50 micrometers with the centroid of the grain size distribution in the range from 10 micrometers to 20 micrometers.

2. The electrode as claimed in claim 1, wherein the material of the tungsten rod has a tungsten fraction of at least 99 percent by weight as well as a fraction of potassium.

3. The electrode as claimed in claim 2, wherein the material of the tungsten rod has fractions of aluminum and silicon.

4. The electrode as claimed in claim 2, wherein the potassium fraction is smaller than or equal to 100 parts per million.

5. A high-pressure discharge lamp with at least one electrode as claimed in claim 1.

6. The high-pressure discharge lamp as claimed in claim 5, having a discharge vessel and at least one electrode arranged therein and whose discharge-side section is formed by a tungsten rod, the discharge-side end of the tungsten rod having a rough or furrowed surface.

7. A high-pressure discharge lamp with at least one electrode as claimed in claim 2.

8. A high-pressure discharge lamp with at least one electrode as claimed in claim 3.

9. A high-pressure discharge lamp with at least one electrode as claimed in claim 4.

* * * * *